US005194125A

United States Patent [19]

Cachet et al.

[11] Patent Number: 5,194,125

[45] Date of Patent: Mar. 16, 1993

[54] PROCESS FOR THE ELECTROEXTRACTION OF ZINC

[75] Inventors: Chantal Cachet; Valerie Mariotte, both of Paris; Robert Wiart, Champs-sur-Marne, all of France

[73] Assignee: Elf Atochem S.A., Puteaux, France

[21] Appl. No.: 814,895

[22] Filed: Jan. 2, 1992

[30] Foreign Application Priority Data

Jan. 7, 1991 [FR] France ..... 91 00110

[51] Int. Cl.[5] ..... C25C 1/16

[52] U.S. Cl. ..... 204/119

[58] Field of Search ..... 204/119

[56] References Cited

U.S. PATENT DOCUMENTS 4,040,916 8/1977 Will et al. ..... 205/313

4,384,930 5/1983 Eckles ..... 205/253

OTHER PUBLICATIONS

"Electrowinning of zinc at highcurrent densities", S. I. Karaivanov, et al., Chemical Abstracts, vol. 106, Jun. 5, 1987, p. 206.

"Electrolytic Production of Zinc at Increased Current Densities", S. I. Karaivanov, et al., English Translation of Chemical Abstract Art.

Derwent Publications, Ltd., Database WPI, No. 78-14683.

*Primary Examiner*—T. M. Tufariello

*Attorney, Agent, or Firm*—Morgan & Finnegan

[57] ABSTRACT

To stabilize the conditions of electroextraction of zinc in an acidic medium and in the presence of metal impurities, there is added to the electrolyte a surface-active compound comprising a perfluoroalkyl grouping linked to a polyoxyethylene, amine-oxide or betaine hydrophilic grouping.

8 Claims, No Drawings

PROCESS FOR THE ELECTROEXTRACTION OF ZINC

FIELD OF THE INVENTION

The present invention relates to the electroextraction of zinc in an acidic medium, especially in a sulphuric medium.

BACKGROUND OF THE INVENTION

In zinc electroextraction which is carried out in an acidic sulphate medium the presence of small quantities of metal impurities (Ge, Sb, Ni, Co, As, etc.) results in difficulties in the process of electrocrystallization of zinc: lowering of the faradic efficiency of the electrocrystallization, stimulation of the release of hydrogen and redissolving of the zinc deposit. Thus, for example, at Ni or Co concentrations higher than 5 mg/l the efficiency rapidly decreases after a stable induction period, the length of which depends on the concentration of the impurity. The elements Ge and Sb have a particularly detrimental effect on the efficiency, even in very low concentrations (approximately 0.1 ppm) and practically without any induction period. The lowering of efficiency caused by an impurity generally goes in hand with a depolarization of the zinc electrode, after an induction period in the case of nickel or cobalt, but virtually immediate in the case of germanium.

Work aimed at remedying these difficulties is based on the use of additives in the electrolyte. The following additives have been investigated in particular:

- lead (E. J. Frazer, J. Electrochem. Soc., 135, 1988, p. 2465)
- gum arabic (M. Maja et al, Oberfläche-Surface, 24, 1983, p. 234)
- glue (D. J. Mackinnon et al, J. Appl. Electrochem., 17, 1987, p. 1129)
- liquorice (T. J. O'Keefee et al, J. Appl. Electrochem., 16, 1986, p. 913)
- 2-butyne-1,4-diol (M. Sider et al, J. Appl. Electrochem, 18, 1988, p. 54)
- a molybdate (M. M. Jaksic, Surf. Coat. Technol., 28, 1986, p. 113)
- tetrabutyl- or tetraethylammonium chloride (D. J. Mackinnon et al, J. Appl. Electrochem., 9, 1979, p. 603)
- a mixture of ethoxyacetylenic alcohol ($HOCH_2C{=}CCH_2OCH_2CH_2OH$), triethylbenzylammonium chloride and polyethylene glycol (Chr. Bozhkov et al, Proceedings of the 7th European Symposium on Corrosion Inhibitors, Ferrara, Suppl. No. 9, 1990, p. 1211).

The ethoxyacetylenic alcohol, which must be present in a high concentration, is not a commercial product. Moreover, it has the disadvantage of being consumed during the electrolysis.

DESCRIPTION OF THE INVENTION

It has now been found that the conditions of electrocrystallization of zinc in the presence of metal impurities (particularly germanium) can be stabilized by employing as an additive a surface-active compound comprising a perfluoroalkyl grouping linked to a polyoxyethylene, amine-oxide or betaïne hydrophilic grouping.

The surface-active compound according to the invention may be selected among the known compounds of formulae:

$$R_F{-}CH_2CH_2O(CH_2CH_2O)_mH \quad \text{(I)}$$

$$R_F(CH_2)_n{-}X{-}\underset{\underset{R}{|}}{N}{-}(CH_2)_p{-}\overset{\overset{R'}{|}}{\underset{\underset{R''}{|}}{N}}O \quad \text{(II)}$$

$$R_F(CH_2)_n{-}X{-}\underset{\underset{R}{|}}{N}{-}(CH_2)_p{-}{}^{+}\overset{\overset{R'}{|}}{\underset{\underset{R''}{|}}{N}}{-}(CH_2)_q{-}COO^{-} \quad \text{(III)}$$

wherein $R_F$ denotes a perfluoroalkyl radical containing from 4 to 20 carbon atoms, m is a number ranging from 6 to 18, n is equal to 0 or 2, p is equal to 2 or 3, q is equal to 1 or 2, X denotes a CO or $SO_2$ group, R denotes a hydrogen atom or an alkyl radical containing from 1 to 4 carbon atoms, and R' and R'', which may be identical or different, each represents an alkyl radical containing from 1 to 4 carbon atoms.

A particularly preferred group of additives according to the invention consists of the compound in which $R_F$ contains from 6 to 10 carbon atoms, R is a hydrogen atom, R' and R'' are methyl groups, X is $SO_2$, m is a number ranging from 10 to 12, n is equal to 2, p is equal to 3, and q is equal to 1.

The quantity of fluorinated surface-active compound to be added to the electrolyte may vary within wide limits as a function of the nature and of the concentration of the metal impurities present in the electrolyte. Without being detrimental to the progress of the electroextraction process, this quantity may generally range from 0.01 to 5 millimoles of additive per liter of electrolyte; it is preferably between approximately 0.1 and 2 mmol/l.

In the case of a given metal impurity there is generally an optimum concentration of fluorinated additive enabling the best efficiency to be obtained. This optimum concentration, which can vary depending on the additive in question and the concentration of the metal impurity, can be easily determined by a person skilled in the art.

EXAMPLES

The following examples illustrate the invention without limiting it.

EXAMPLE 1

An electrolyte containing 120 g/l of $H_2SO_4$, 55 g/l of $Zn^{2+}$ and 90 mg/l of nickel is employed. The electrolysis is performed in the following conditions:

current density: 50 mA/cm$^2$
temperature: 36° C.
vertical aluminum electrode
without stirring.

When the electrode potential is followed in the course of time it is found that the induction period (that is to say the time for destabilizing the system) is 15 minutes.

This time is longer than 48 hours when the test is reproduced by adding to the electrolyte 0.33 millimoles/liter of the compound $C_6F_{13}CH_2CH_2O(CH_2CH_2O)_{11}H$.

In the presence of manganese (15.4 g/l) in the electrolyte the induction period falls back to 4 hours, since manganese stimulates the release of hydrogen. This period rises again to 72 hours when the concentration of the compound $C_6F_{13}CH_2CH_2O(CH_2CH_2O)_{11}H$ in the electrolyte is adjusted to 2 millimoles/liter.

EXAMPLE 2

The electrolysis is performed in the same conditions as in Example 1 with an electrolyte containing 120 g/l of $H_2SO_4$, 55 g/l of $Zn^{2+}$ and various concentrations of germanium.

In the absence of additive a virtually immediate destabilization of the electrolysis conditions is observed, with redissolution of the zinc deposit.

Addition of the compound $C_6F_{13}CH_2CH_2O(CH_2CH_2O)_{11}H$ enables the electrode potential to be stabilized for at least 8 hours. The faradic efficiency of the electrocrystallization then varies as a function of the concentrations of germanium and of the polyfluoro compound (see the following table).

| Concentration in the electrolyte, of: | | |
|---|---|---|
| Germanium (mg/liter) | $C_6F_{13}C_2H_4O(C_2H_4O)_{11}H$ (millimoles/liter) | Faradic efficiency (%) |
| 0.127 | 0 | 0 |
| 0.127 | 0.094 | 88.9 |
| 0.254 | 0.094 | 88.3 |
| 0.381 | 0.094 | 55.7 |
| 0.508 | 0.094 | 49.2 |
| 0.508 | 0.190 | 79.6 |
| 0.508 | 0.280 | 73.8 |
| 0.635 | 0.280 | 75.4 |
| 0.889 | 0.280 | 84.5 |
| 1.180 | 0.280 | 71.7 |
| 1.180 | 0.380 | 74.0 |
| 1.180 | 0.470 | 76.2 |
| 1.180 | 0.570 | 61.0 |
| 1.700 | 0.570 | 63.0 |
| 2.100 | 0.570 | 75.7 |
| 2.300 | 0.570 | 73.4 |

In the presence of the polyfluoro compound the optimum efficiency always corresponds to fine-grained zinc deposits without any impression left by the hydrogen bubbles.

EXAMPLE 3

The electrolysis is performed in the same conditions as in Example 1, with an electrolyte containing 120 g/l of $H_2SO_4$, 55 g/l of $Zn^{2+}$ and 1.18 mg/l of germanium.

Addition of the compound (A) or (B) below enables the electrode potential to be stabilized for at least 8 hours.

(A)=$C_6F_{13}C_2H_4SO_2NHC_3H_6NO(CH_3)_2$ (B)=$C_6F_{13}C_2H_4SO_2NHC_3H_6N^+(CH_3)_2CH_2CO_2^{-}$.

The table which follows shows the change in the faradic efficiency of the electrocrystallization, as a function of the concentration of compound A or B.

| Additive | Concentration (millimole/liter) | Faradic efficiency (%) |
|---|---|---|
| A | 0.27 | 47.2 |
| " | 0.40 | 62.0 |
| " | 0.53 | 67.7 |
| " | 0.80 | 68.0 |
| B | 0.27 | 66.9 |
| " | 0.36 | 60.4 |
| " | 0.45 | 68.9 |
| " | 0.54 | 71.3 |

With these compounds A and B, there are obtained fairly homogeneous efficiencies. The zinc deposits consist of aggregates of parallel lamellae which are disposed perpendicularly to the aluminium substrate.

EXAMPLE 4

An electrolyte containing 120 g/l of $H_2SO_4$, 55 g/l of $Zn^{2+}$ and 4.16 (or 8.32) mg/l of nickel is employed and the electrolysis is performed in the same conditions as in Example 1.

In the absence of surfactant the potential is destabilized and the faradic efficiency falls to zero within eight hours.

The electrode potential is stabilized for more than 8 hours when 0.094 millimoles/liter of the compound $C_6F_{13}CH_2CH_2O(CH_2CH_2O)_{11}H$ is added to the electrolyte. The faradic efficiency is about 86%.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

We claim:

1. Process for electroextraction of zinc in an acidic medium, comprising adding to electrolyte a fluorinated surface-active compound selected from the group consisting of the compounds of formulae:

$$R_F-CH_2CH_2O(CH_2CH_2O)_mH \quad \text{(I)}$$

$$R_F(CH_2)_n-X-\underset{\underset{R}{|}}{N}-(CH_2)_p-\overset{\overset{R'}{|}}{\underset{\underset{R''}{|}}{N}}O \quad \text{(II)}$$

$$R_F(CH_2)_n-X-\underset{\underset{R}{|}}{N}-(CH_2)_p-\overset{\overset{R'}{|}}{\underset{\underset{R''}{|}}{{}^+N}}-(CH_2)_q-COO^- \quad \text{(III)}$$

wherein $R_F$ denotes a perfluoroalkyl radical containing from 4 to 20 carbon atoms, m is a number ranging from 6 to 18, n is equal to 0 or 2, p is equal to 2 or 3, q is equal to 1 or 2, X denotes a CO or $SO_2$ group, R denotes a hydrogen atom or an alkyl radical containing from 1 to 4 carbon atoms, and R' and R'', which may be identical or different, each represents an alkyl radical containing from 1 to 4 carbon atoms.

2. Process according to claim 1, wherein $R_F$ contains from 6 to 10 carbon atoms, R is a hydrogen atom, R' and R'' are methyl groups, X is $SO_2$, m is a number ranging from 10 to 12, n is equal to 2, p is equal to 3, and q is equal to 1.

3. Process according to claim 1, wherein the compound $C_6F_{13}CH_2CH_2O(CH_2CH_2O)_{11}H$ is employed as additive.

4. Process according to claim 1, wherein the compound $C_6F_{13}CH_2CH_2SO_2NHC_3H_6NO(CH_3)_2$ is employed as additive.

5. Process according to claim 1, wherein the compound $C_6F_{13}C_2H_4SO_2NHC_3H_6N^+(CH_3)_2CH_2CO_2^-$ is employed as additive.

6. Process according to claim 1, wherein the electrolyte contains from 0.01 to 5 millimoles of fluorinated additive per liter.

7. Process according to claim 1, wherein the operation is carried out in a sulphuric acid medium.

8. Process according to claim 1, wherein the content of the fluorinated additive is between about 0.1 and 2 millimoles/liter.

* * * * *